US006120961A

United States Patent [19]

Tanikawa et al.

[11] Patent Number: 6,120,961

[45] **Date of Patent: *Sep. 19, 2000**

[54] TONER FOR DEVELOPING ELECTROSTATIC IMAGES

[75] Inventors: Hirohide Tanikawa; Masami Fujimoto, both of Shizuoka-ken; Tsutomu Onuma, Yokohama; Hiroyuki Fujikawa, Numazu, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,846

[22] Filed: Sep. 26, 1997

[30] Foreign Application Priority Data

Oct. 2, 1996 [JP] Japan ..... 8-261787

[51] Int. Cl.[7] ..... G03G 9/08

[52] U.S. Cl. ..... 430/110; 430/109; 430/137

[58] Field of Search ..... 430/110, 137, 430/109

[56] References Cited

U.S. PATENT DOCUMENTS

| | | | |
|---|---|---|---|
| 4,578,338 | 3/1986 | Gruber et al. | 430/120 |
| 4,917,982 | 4/1990 | Tomono et al. | 430/99 |
| 4,921,771 | 5/1990 | Tomono et al. | 430/110 |
| 4,990,424 | 2/1991 | Van Dusen et al. | 430/106.6 |
| 5,176,978 | 1/1993 | Kumashiro et al. | 430/110 |
| 5,292,609 | 3/1994 | Yoshikawa et al. | 430/110 |
| 5,364,722 | 11/1994 | Tanikawa et al. | 430/110 |
| 5,384,224 | 1/1995 | Tanikawa et al. | 430/106 |
| 5,605,778 | 2/1997 | Onuma et al. | 430/110 |
| 5,707,771 | 1/1998 | Matsunaga | 430/110 |

FOREIGN PATENT DOCUMENTS

| | | |
|---|---|---|
| 0417016 | 3/1991 | European Pat. Off. . |
| 0572896 | 12/1993 | European Pat. Off. . |
| 0686885 | 12/1995 | European Pat. Off. . |
| 52-3304 | 1/1977 | Japan . |
| 52-3305 | 1/1977 | Japan . |
| 57-52574 | 11/1982 | Japan . |
| 58-215659 | 12/1983 | Japan . |
| 60-217366 | 10/1985 | Japan . |
| 60-252360 | 12/1985 | Japan . |
| 60-252361 | 12/1985 | Japan . |
| 61-94062 | 5/1986 | Japan . |
| 61-138259 | 6/1986 | Japan . |
| 61-273554 | 12/1986 | Japan . |
| 62-10775 | 1/1987 | Japan . |
| 62-14166 | 1/1987 | Japan . |
| 62-100775 | 5/1987 | Japan . |
| 1-109359 | 4/1989 | Japan . |
| 2-79860 | 3/1990 | Japan . |
| 3-50559 | 3/1991 | Japan . |
| 4-124676 | 4/1992 | Japan . |
| 4-299357 | 10/1992 | Japan . |
| 4-362953 | 12/1992 | Japan . |
| 5-197192 | 8/1993 | Japan . |

OTHER PUBLICATIONS

Patent Abstract of Japan, vol. 9, No. 327 (P–415) '2050', Dec. 1985 for JP 60–151650.

*Primary Examiner*—Christopher D. Rodee

*Attorney, Agent, or Firm*—Fitzpatrick, Cella, Harper & Scinto

[57] ABSTRACT

A toner for developing an electrostatic image includes a binder resin, a colorant and a wax. The toner shows heat-absorption characteristics represented by a DSC heat-absorption curve obtained on temperature increase in a temperature range of 30–150° C. by a differential scanning colorimeter (DSC). The DSC heat-absorption curve shows a maximum heat-absorption peak (P1) in a temperature range of 70–90° C. The DSC curve also provides a differential curve showing a first maximum (Max1) on a lowest temperature side at a temperature (T1) of 50–65° C., showing a second maximum (Max2) on a next lowest temperature side at a temperature (T2) of 65–85° C., and showing a minimum (Min1) on a highest temperature side at a temperature (T3) of at least 95° C. Because of the DSC heat-absorption characteristics, the toner exhibits excellent fixability (including anti-offset characteristic) over a wide temperature range and excellent continuous image forming characteristic.

15 Claims, 3 Drawing Sheets

TONER FOR DEVELOPING ELECTROSTATIC IMAGES

FIELD OF THE INVENTION AND RELATED ART

The present invention relates to a toner for developing electrostatic image used in an image forming method, such as electrophotography or electrostatic recording.

It has been a general particle to incorporate a wax in toner particles for a toner for heat-pressure fixation in order to improve the fixability and anti-offset characteristic. Such wax-containing toners are disclosed in, e.g., Japanese Patent Publication (JP-B 52-3304), JP-B 52-3305 and JP-B 57-52574.

Such wax-containing toners are also disclosed in Japanese Laid-Open Patent Application (JP-A) 3-50559, JP-A 2-79860, JP-A 1-109359, JP-A 62-14166, JP-A 61-273554, JP-A 61-94062, JP-A 61-138259, JP-A 60-252361, JP-A 60-252360, and JP-A 60-217366.

Waxes have been used for providing a toner with improved anti-offset characteristics at a low temperature and a high temperature and also an improved fixability at a low temperature. While a wax may improve these performances, however, it can sometimes provide the resultant toner with a lower anti-blocking property, a lower developing performance or a liability of wax blooming leading to a lower developing performance during a long term storage. Moreover, the wax inclusion can result in difficulties during continuous image formation on a large number of sheets, such as a lowering in toner developing performance and soiling of a developing sleeve resulting in a lowering in image density and increased fog.

Toners containing two or more waxes in combination so as to exhibit the wax addition effect from a low-temperature region to a high-temperature region have been also disclosed in JP-B 52-3305, JP-A 58-215659, JP-A 62-100775, JP-A 4-124676, JP-A 4-299357, JP-A 4-362953 and JP-A 5-197192.

However, these toners also suffer from some problems, examples of which may include: a lowering in low-temperature fixability accompanying excellent anti-high temperature offset characteristic and developing performance, somewhat inferior anti-blocking property and lower developing performance accompanying excellent anti-low-temperature offset characteristic and low-temperature fixability, improper harmonization of anti-offset characteristics at low temperature and high temperature, and occurrence of blotchy image defects or fog on images due to irregular toner coating on a developing sleeve caused by free-wax components.

Further, while toners containing a low-molecular weight polypropylene (e.g., Viscol 550P, 660P, etc., available from Sanyo Kasei Kogyo K.K.) are commercially available, it has been still desired to develop a toner having further improved anti-high-temperature offset characteristic and low-temperature fixability.

SUMMARY OF THE INVENTION

A generic object of the present invention is to provide a toner for developing electrostatic images having solved the above-mentioned problems.

A more specific object of the present invention is to provide a toner for developing electrostatic images having excellent fixability and anti-offset characteristic as well as excellent developing performance.

Another object of the present invention is to provide a toner for developing electrostatic images with little deterioration in developing performance during continuous image formation.

A further object of the present invention is to provide a toner for developing electrostatic images less liable to cause soiling from a fixed toner image on a transfer-receiving material.

A still further object of the present invention is to provide a toner for developing electrostatic images less liable to cause the winding of a transfer-receiving material about a heat-fixing member.

According to the present invention, there is provided a toner for developing an electrostatic image, comprising: a binder resin, a colorant and a wax;

wherein the toner shows heat-absorption characteristics represented by a DSC heat-absorption curve obtained on temperature increase in a temperature range of 30–150° C. by a differential scanning colorimeter (DSC);

said DSC heat-absorption curve showing a maximum heat-absorption peak (P1) in a temperature range of 70–90° C., said DSC curve providing a differential curve showing a first maximum (Max1) on a lowest temperature side at a temperature (T1) of 50–65° C., showing a second maximum (Max2) on a next lowest temperature side at a temperature (T2) of 65–85° C., and showing a minimum (Min1) on a highest temperature side at a temperature (T3) of at least 95° C.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 2:
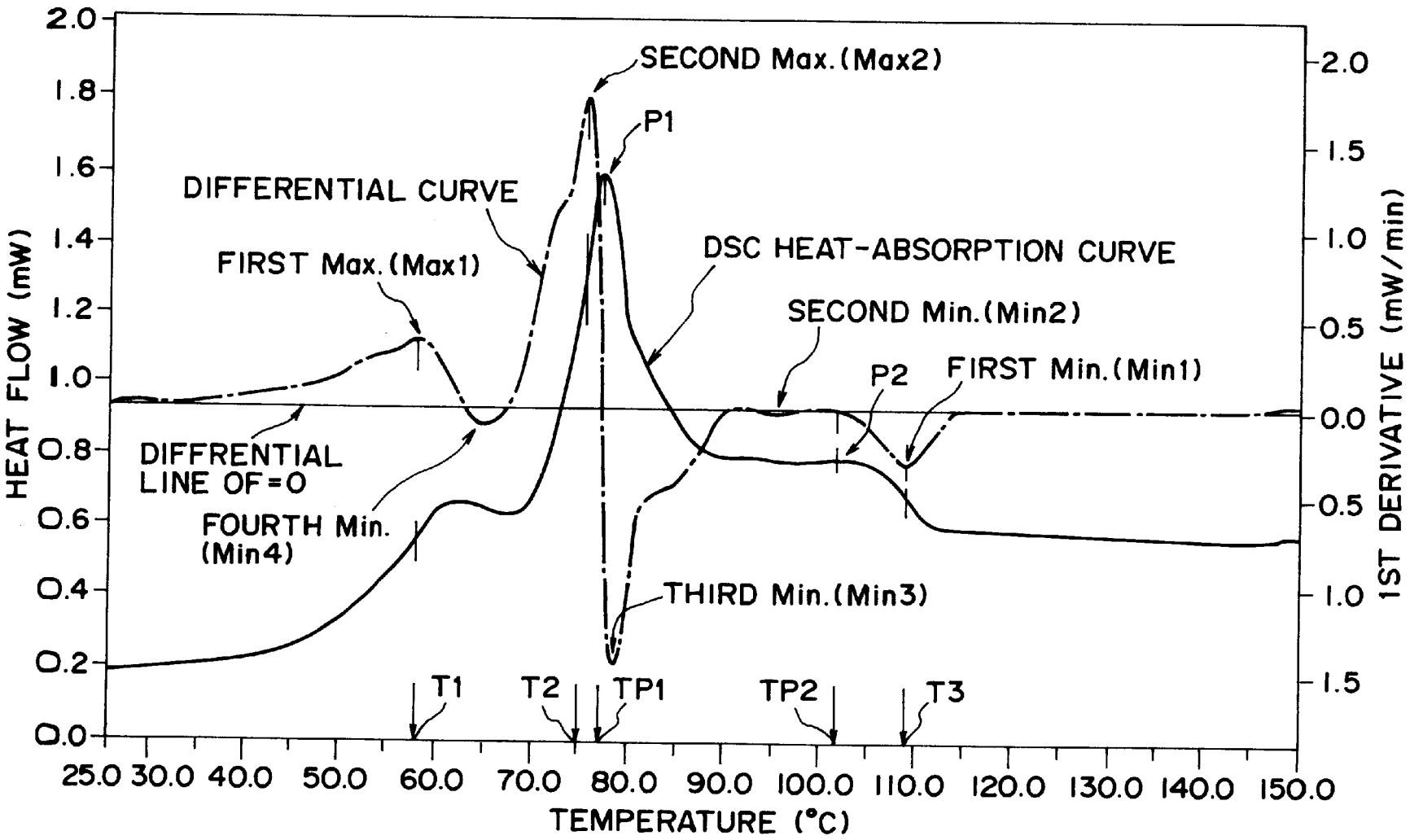
FIG. 2 illustrates various parameters on DSC heat-absorption curve and its differential curve.
Figure 3:
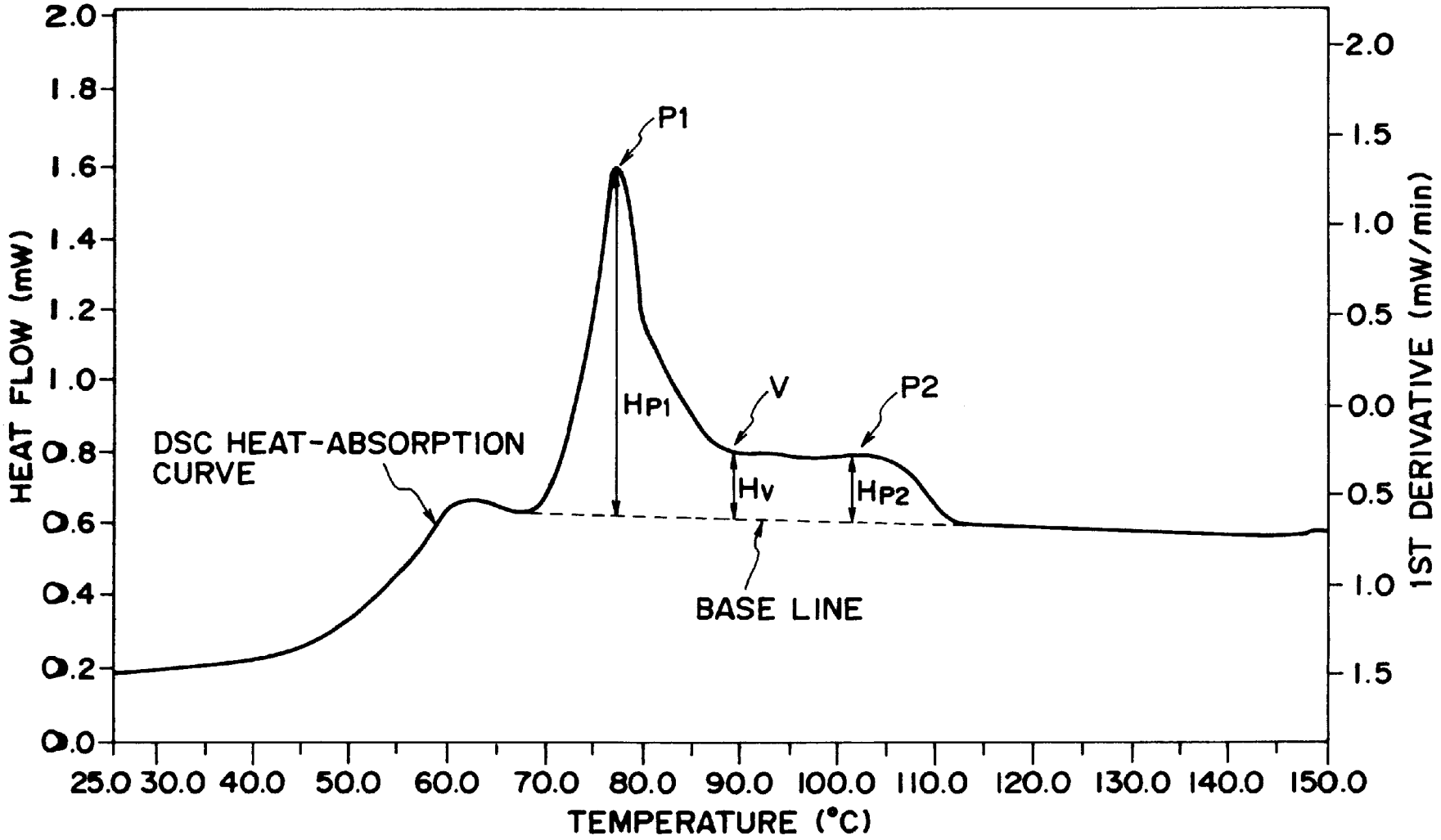
FIG. 3 illustrates a manner of measuring heat-absorption peak heights on a toner DSC heat-absorption curve.

From analysis of a DSC heat-absorption curve of a toner obtained by using a differential scanning calorimeter (DSC), it is possible to observe a thermal behavior of the toner, and know heat transfer to and from the toner and changes in state of the toner. Accordingly, from a DSC heat-absorption curve of a toner, it is possible to have a knowledge about thermal response of the toner in electrophotography. In describing the present invention based on a DSC curve, an absorbed heat is taken (or indicated) in the positive (or upward) direction. The thermal behavior of a toner appears as a result of interaction between a binder resin and a wax constituting toner particles, so that it is also possible to know the states of presence of the binder resin and the wax in the toner particles. For example, it is possible to know or analogize the dispersion state of the wax in the toner particles and a mutually interacting state between the binder resin and the wax. The control of such thermal behaviors and accordingly DSC curve patterns can be controlled through the control or selection of a binder resin molecular structure, a wax molecular structure and a state of dispersion of the wax in the binder resin. Some explanations will now be made on a DSC heat-absorption curve of a toner with reference to FIGS. 1 to 3.

On a DSC heat-absorption curve of a toner in a temperature range of 30–150° C., a first appearing slope of increased heat-absorption represents a thermal behavior accompanying glass transition of the toner accompanying an interaction between the binder resin and the wax, and a point (temperature) giving a maximum of the slope represents a point (temperature) where the state transition becomes the largest (or the most extensive). The point (temperature) giving the maximum slope on the DSC heat-absorption curve is a point giving a maximum (i.e., a peak) on a differential curve derived from (or obtained by plotting differential values with respect to time (or first derivatives with respect to time)) taken along the DSC heat-absorption curve. A temperature (T1) giving a first maximum (Max1) on the differential curve is related with the fixability and storage stability of the toner. If the temperature T1 is in the range of 50–65° C., preferably 50–60° C., it is possible to provide an improved low-temperature fixability of toner while retaining the storage stability of the toner. If the temperature (T1) of a toner is below 50° C., the toner is caused to have a lower storage stability. On the other hand, if T1 is above 65° C., the toner is caused to have inferior low-temperature fixability.

A second increase of absorbed heat on the DSC heat-absorption curve in the temperature range of 30–150° C. represents a thermal behavior accompanying a plasticizing effect of the wax on the toner, and a second point (temperature) giving a maximum slope on the DSC heat-absorption curve represents a point (temperature) where the wax starts to exhibit its plasticizing effect. The second point (temperature) giving a maximum slope on the DSC heat-absorption curve is a point (temperature T2) giving a second maximum (peak) (Max2) on the differential curve. The temperature T2 giving the second maximum (Max2) on the differential curve is also related with the low temperature fixability and storage stability of the toner and, if the temperature T2 is in the range of 65–85° C., preferably 65–80° C., further preferably 70–80° C., it is possible to provide an improved toner fixability while retaining the toner storage stability. If the temperature T2 is below 65° C., the storage stability of the toner is lowered. On the other hand, if the temperature T2 exceeds 85° C., the low-temperature fixability becomes inferior.

A maximum heat-absorption peak (P1) on the toner DSC heat-absorption curve represents a thermal behavior accompanying the melting of the wax, and the temperature giving the maximum heat-absorption peak (P1) is a point (temperature) where the plasticizing effect of the wax on the binder resin is saturated. Accordingly, the temperature (TP1) giving the maximum heat-absorption peak (P1) is also related with the low-temperature fixability and the storage stability of the toner and, if the temperature TP1 is in the range of 70–90° C., preferably 70–85° C., it is possible to further improve the low-temperature fixability of the toner while retaining the toner storage stability. If the maximum heat-absorption peak temperature TP1 is below 70° C., the toner storage stability is lowered. On the other hand, if the temperature TP1 exceeds 90° C., the plasticizing effect of the wax become insufficient to lower the low-temperature fixability of the toner.

It is preferred that the toner DSC heat-absorption curve shows a sub-heat-absorption peak or shoulder (each defined as a point giving a differential of 0) giving a height (Hp2) which is 0.8 times the height (Hp1) of the maximum heat-absorption peak P1, respectively, measured from the base line (FIG. 3) in order to provide a further improved fixability of the toner.

A point (temperature T3) giving a minimum slope on the highest temperature side on the toner DSC heat-absorption curve in the temperature range of 30–150° C. is a point (temperature) where the wax melting is substantially completed and is related with the anti-high-temperature offset characteristic of the toner. The temperature T3 is also a point temperature giving a minimum (Min1) on the highest temperature side on the differential curve. If the temperature T3 giving the highest temperature-minimum (Min1) on the DSC heat-absorption differential curve is at least 95° C., preferably at least 100° C., more preferably 100 130° C., particularly preferably 100–120° C., the toner is provided with an improved anti-high-temperature offset characteristic. If the temperature T3 giving the highest temperature minimum (Min1) is below 95° C., the wax completes its melting at a low temperature to show a good compatibility with the binder resin or show too low a viscosity so that the wax film does not effectively operates, thus being liable to fail in exhibiting the release effect and peeling effect at a high temperature. If the temperature T3 exceeds 130° C., the wax melting is liable to be insufficient or provide too large a viscosity. Also in this case, the wax is liable to be fail in sufficient film formation and the exhibition of the release effect and peeling effect is liable to be difficult. In these cases, the peelability between the heat-fixing member and the transfer-receiving material (or paper) can be lowered, so that the transfer-receiving material carrying a fixed toner image is liable to be wound about the heat-fixing member and the separation thereof with a paper-separation claw can result in separation claw traces on the fixed images. In a severer case, the separation with the separation claw becomes impossible to leave the transfer-receiving material wound about the heat-fixing member.

In order to promote more effective release and peeling of the toner from the heat-fixing member, it is preferred that the toner DSC heat-absorption curve shows a sub-peak or shoulder (P2) (including one represented by a differential value of zero) in a temperature range of 85–115° C., more preferably 90–110° C. In order to provide a better fixability, it is further preferred that the peaks P1 and P2 (or the peak P1 and shoulder P2) provide a height ratio Hp2/Hp1 of at most 0.7, more preferably at most 0.5.

Further, if the temperatures T3 and T2 provide a difference therebetween of at least 25° C., it is possible to provide a broad fixable temperature range (i.e., a temperature range between a lowest fixable temperature to a temperature causing a high-temperature offset). It is particularly preferred that the temperature difference is at least 30° C. Further, it is preferred that a valley V forming a lowest point on the DSC heat-absorption curve between P1 and P2 provides a height Hv giving a ratio Hv/Hp2 (FIG. 3) of at least 0.5, more preferably at least 0.6, so as to provide a uniform wax film on a fixed image surface, whereby the fixed image is not easily peeled even when the fixed image is rubbed, and the document or related devices are not soiled or less liable to be soiled. For example, in the case of forming image on both sides or superposed printed images, a transfer-receiving material having an already formed image can be processed for further image formation thereon or on an opposite side, without or little soiling of another sheet of transfer-receiving material thereon or therebelow. Further, as the related process members are less liable to be soiled by passing of such a transfer-receiving material carrying an already fixed image, transfer-receiving material later passing by the process members are less liable to be soiled thereby. Further, in the case of feeding plural sheets of such transfer-receiving materials by means of an automatic document feeder to a copying apparatus, similar soiling of transfer-receiving materials or related process member due to rubbing with the transfer-receiving materials carrying fixed images is prevented or suppressed.

The DSC measurement for characterizing the present invention is used to evaluate heat transfer to and from a toner and observe the behavior, and therefore should be performed by using an internal heating input compensation-type differential scanning calorimeter which shows a high accuracy based on the measurement principle. A commercially available example thereof is "DSC-7" (trade name) mfd. by Perkin-Elmer Corp. In this case, it is appropriate to use a sample weight of about 10–15 mg for a toner or binder resin sample or about 2–5 mg for a wax sample.

Figure 1:
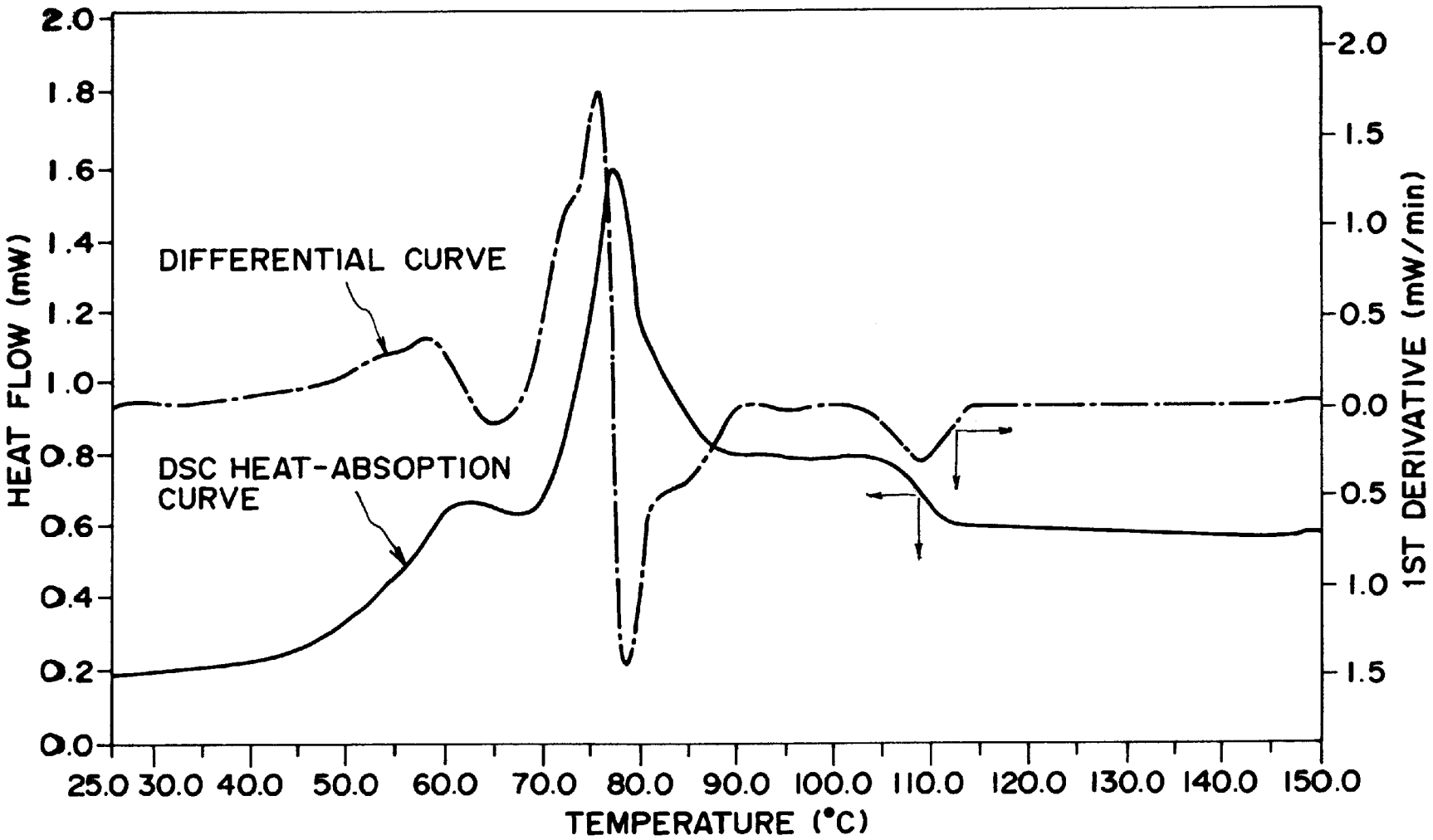
FIG. 1 is a graph showing a DSC heat-absorption curve of a toner and a differential curve derived from the DSC heat-absorption curve.

The measurement may be performed according to ASTM D3418-82. Before a DSC curve is taken, a sample is once heated and cooled for removing its thermal history and then subjected to heating (temperature increase) at a rate of 10° C./min. in a temperature range of 30° C. to 150° C. for taking DSC curves. The temperatures or parameters characterizing the invention are defined as follows. FIG. 1 shows an example of a DSC heat-absorption curve and a differential curve derived therefrom.

Temperature (T1)

A temperature first giving a maximum slope on a DSC heat-absorption curve in a temperature range of 30–150° C. when the curve is traced from its lower temperature side, and also a temperature first giving a positive maximum (peak) on a differential curve derived from the DSC heat-absorption curve.

Temperature (T2)

A temperature secondly giving a maximum slope on a DSC heat-absorption curve in a temperature range of 30–150° C. when the curve is traced from its lower temperature side, and also a second lowest temperature giving a maximum (peak) on a differential curve of the DSC heat-absorption curve.

Temperature (T3)

A temperature finally giving a minimum slope on a DSC heat-absorption curve in a temperature range of 30–150° C. when the curve is traced from its lower temperature side, and also the highest temperature giving a negative minimum (valley) on the corresponding differential curve.

P1 (Maximum Heat-absorption Peak)

The largest heat-absorption peak in the temperature range of 30–150° C. giving a peaktop temperature called a peak temperature (TP1) of the maximum heat-absorption peak.

P2 (Sub-peak or Shoulder)

A point in the temperature range of 85–115° C. where the differential curve (of the DSC heat-absorption curve) assumes 0 or a maximum is called a sub-peak or shoulder (P2), and the temperature at the point is called a sub-peak or shoulder temperature (TP2). A sub-peak is selected in case where a differential value of 0 (zero obtained in the course of positive differential values to negative differential values) is present, and a shoulder is selected in case of no differential value=0 giving a negative maximum among differential values. In case where a broad shoulder is present so that a sub-peak or a shoulder is difficult to confirm, a position indicating a clear transition of differential value from nearly 0 to a negative value is taken as the position of a sub-peak or shoulder. In case where a plurality of sub-peaks or shoulders are present, the highest temperature side one is selected.

Peak Height

A base line is drawn by connecting two points on a DSC heat-absorption curve including a first point at a temperature between T1 and T2 where the DSC heat-absorption curve provides a differential of 0 by transition from negative to positive or a positive minimum of differential and a second point at a temperature above T3 where the differential of the DSC heat-absorption curve assumes almost 0. Then, the height from the base line is taken for each peak, shoulder or valley.

In the case where the point (temperature) above T3 is set, it is possible to use a DSC heat-absorption curve and a differential curve derived therefrom up to 200° C.

Preferred examples of the wax may include: polyolefins obtained by radical polymerization of olefins at high pressures; polyolefins obtained by purification of low-molecular weight by-products formed during producing polymerization for high-molecular weight polyolefins; polyolefins formed by polymerization at low pressures in the presence of a catalyst, such as a Ziegler catalyst or a metallocene catalyst; polyolefins formed by polymerization with utilization of radiation, electromagnetic wave or light; low-molecular weight polyolefins obtained by thermal decomposition of high-molecular weight polyolefins; paraffin wax, microcrystalline wax, Fischer-Tropsche wax; synthetic hydrocarbon waxes obtained through process, such as the Synthol process, the Hydrocol process and the Arge process; synthetic waxes obtained from mono-carbon compound as a monomer; and hydrocarbon waxes having terminal functional group, such as hydroxyl group or carboxyl group. These waxes may preferably be used in mixture of two or more species.

These waxes may preferably be treated by the press sweating method, the solvent method, re-crystallization, vacuum distillation, supercritical gas extraction or melt-crystallization so as to provide a narrower molecular weight distribution or remove impurities, such as aliphatic acids, alcohols, or low-molecular weight compounds.

The characteristic heat-absorption properties of the toner according to the present invention may preferably be accomplished by dispersing an appropriate combination of plural species of waxes in a total amount of 1–20 wt. parts, more preferably 1–10 wt. parts, in 100 wt. parts of a binder resin. For the wax selection, it is preferred to use two or more species of waxes having a number-average molecular weight (Mn) of 200–5000, more preferably 250–2000, further preferably 300–1500, and a weight-average molecular weight/number-average molecular weight (Mw/Mn) ratio of at most 3.0, more preferably at most 2.0, respectively, based on the molecular weight distribution measurement by gel permeation chromatography. A further preferred result may be attained by using a combination of a relatively low-molecular weight wax and a relatively high-molecular weight wax.

It is particularly preferred to use a mixture wax comprising (i) a polymethylene wax having Mn=200– 600 and Mw/Mn=1.2–2.1 and (ii) a polymethylene wax having Mn=700–1500 and Mw/Mn=1.2–2.0 in view of low-temperature fixability and anti-high temperature-offset characteristic. The polymethylene wax (i) and the polymethylene wax (ii) may preferably be blended in a weight ratio of 9:1 to 3:7, more preferably 8:2 to 4:6.

The molecular weight distribution of hydrocarbon wax may be obtained based on measurement by GPC (gel permeation chromatography), e.g., under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

The binder resin for constituting the toner according to the present invention may preferably have a glass transition temperature (Tg) of 50–70° C., more preferably 55–65° C.

The glass transition point of a binder resin may be measured according to ASTM D3418-82. Before a DSC curve is taken, a binder resin sample is once heated and cooled for a removing its thermal history and then subjected to heating at a rate of 10° C./min.

The glass transition point (Tg) is determined by drawing an intermediate line between base lines before and after a specific heat change on a DSC curve and taking a temperature at which the intermediate line intersects the DSC curve as Tg of the sample.

The binder resin for the toner of the present invention may for example comprise: polystyrene; homopolymers of styrene derivatives, such as poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

The binder resin may be produced through bulk polymerization, solution polymerization, suspension polymerization or emulsion polymerization.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight polymer or copolymer used in the binder resin of the present invention.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization. The reaction temperature may depend on the solvent and initiator used and the polymer or copolymer to be produced but may suitably be in the range of 70–230° C. In the solution polymerization, it is preferred to use 30–400 wt. parts of a monomer (mixture) per 100 wt. parts of the solvent. It is also preferred to mix one or more other polymers in the solution after completion of the polymerization.

In order to produce a high-molecular weight polymer component or a gel component, the emulsion polymerization or suspension polymerization may preferably be adopted.

Of these, in the emulsion polymerization method, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

On the other hand, in the suspension polymerization method, it is possible to obtain a product resin composition in a uniform state of pearls containing a medium- or high-molecular weight component uniformly mixed with a low-molecular weight component and a crosslinked component by polymerizing a vinyl monomer (mixture) containing a low-molecular weight polymer together with a crosslinking agent in a suspension state.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50–95° C. and selected depending on the polymerization initiator used and the objective polymer. The polymerization initiator should be insoluble or hardly soluble in water, and may be used in an amount of 0.5–10 wt. parts per 100 wt. parts of the vinyl monomer (mixture).

Examples of the initiator may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylonitrile, 2,2'-azobis(2-methylbutyronitrile, 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl-4,4-bis (t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy) hexane, di-t-butyldiperoxyisophthalate, 2,2-bis(4,4-di-t-butylperoxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di-(t-butylperoxy) hexane, diethylene glycol-bis(t-butylperoxycarbonate), di-t-butylperoxytrimethyl-azipate, tris(t-butylperoxy)triazine, and vinyl-tris(t-butylperoxy)silane. These initiators may be used singly or in combination in an amount of at least 0.05 wt. part, preferably 0.1–15 wt. parts, per 100 wt. parts of the monomer.

The polyester resin used in the present invention may be constituted as follows.

Examples of the dihydric alcohol may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

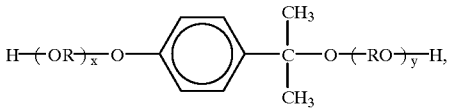

wherein R denotes an ethylene or propylene group, x and y are independently 0 or a positive integer with the proviso that the average of x+y is in the range of 0–10; and diols represented by the following formula (B):

(B)

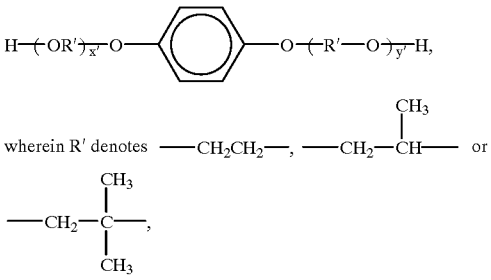

x' and y' are independently 0 or a positive integer with the proviso that the average of x'+y' is in the range of 0–10.

Examples of the dibasic acid may include dicarboxylic acids and derivatives thereof including: benzenedicarboxylic acids, such as phthalic acid, terephthalic acid and isophthalic acid, and their anhydrides or lower alkyl esters; alkyldicarboxylic acids, such as succinic acid, adipic acid, sebacic acid and azelaic acid, and their anhydrides and lower alkyl esters; alkenyl- or alkylsuccinic acid, such as n-dodecenylsuccinic acid and n-dodecyl acid, and their anhydrides and lower alkyl esters; and unsaturated dicarboxylic acids, such as fumaric acid, maleic acid, citraconic acid and itaconic acid, and their anhydrides and lower alkyl esters.

It is preferred to also use polyhydric alcohols having three or more functional groups and polybasic acids having three or more acid groups.

Examples of such polyhydric alcohol having three or more hydroxyl groups may include: sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of polybasic carboxylic acids having three or more functional groups may include polycarboxylic acids and derivatives thereof including: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Empol trimer acid, and their anhydrides and lower alkyl esters; and tetracaboxylic acids represented by the formula:

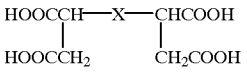

(X denotes a $C_5$ to $C_{30}$-alkylene group or alkenylene group having at least one side chain having at least three carbon atoms), and their anhydrides and lower alkyl esters.

The polyester resin used in the present invention may preferably be constituted from 40–60 mol. %, more preferably 45–55 mol. %, of the alcohol component and 60–40 mol. %, more preferably 55–45 mol. %, of the acid component respectively based on the total of the alcohol and acid components. Further, the total of the polyhydric alcohol and the polybasic acid each having three or more functional groups may preferably constitutes 5–60 mol. % of the total alcohol and acid components constituting the polyester resin.

In view of the developing performance, fixability, durability and cleanability, it is preferred to use a copolymer of styrene and an unsaturated carboxylic acid derivative, polyester resin, a block copolymer or a grafted product of these, or a mixture of a styrene copolymer and a polyester resin.

The binder resin used in the present invention may preferably by have a molecular weight distribution as measured GPC (gel permeation chromatography) showing a peak in a molecular weight region of at least $10^5$ and further preferably also a peak in a region of $3\times10^3$–$5\times10^4$ in view of fixability and durability.

Preferred examples of the binder resin may include: styrene-acrylic copolymers, styrene-methacrylic-acrylic copolymers, styrene-methacrylic copolymers, styrene-butadiene copolymers, polyester resins, and block copolymers, grafted products and blends of these resins, for positively chargeable toners; and styrene-acrylic copolymers, styrene-methacrylic-acrylic copolymers, styrene-methacrylic copolymers, copolymers of monomers constituting the above copolymers and maleic acid monoester, polyester resins, and block copolymers, grafted products and blends of these resins, for negatively chargeable toners; respectively, in order to provide a good developing performance.

In the case of a toner using a styrene copolymer as a binder resin, the toner may preferably be constituted so as to satisfy the following conditions in order to fully exhibit the wax addition effect while preventing deterioration of anti-blocking property and developing performance as adverse effects accompanying the plasticizing with the wax.

More specifically, the toner may preferably comprise a resinous THF (tetrahydrofuran)-soluble content which provides a molecular weight distribution as measured by GPC (gel permeation chromatography) showing at least one peak in a molecular weight region of $3\times10^3$–$5\times10^4$, more preferably $3\times10^3$–$3\times10^4$, further preferably $5\times10^3$–$2\times10^4$, so as to provide good fixability, developing performance and anti-blocking property. If the peak is present at a molecular weight of below $3\times10^3$, the anti-blocking property is lowered and, on the other hand, if the molecular weight exceeds $5\times10^4$, the fixability is lowered. If at least one peak is also present in a molecular weight region of at least $1\times10^5$, preferably $3\times10^5$–$5\times10^6$, it is possible to obtain good anti-high-temperature offset characteristic, anti-blocking property and developing performance. If the high-molecular weight side peak is present at a higher molecular weight, a better anti-high-temperature offset characteristic can be attained. However, in case where a peak is present in a molecular weight region exceeding $5\times10^6$, no problem may occur if heating rollers capable of exerting a large pressure are used but the fixability is lowered because of a high elasticity if a large pressure cannot be applied. Accordingly, in the case of providing a toner adapted to a medium- or low-speed image forming apparatus using a heat-fixing apparatus adopting a relatively low pressure, it is preferred that a peak is present in a molecular weight region of $3\times10^5$–$2\times10^6$ and the peak is the largest peak in the molecular weight region of at least $1\times10^5$.

It is preferred that the THF-soluble content contains at least 50% (areal % on a GPC chromatogram), more preferably 60–90%, particularly preferably 65–85%, of a component in a molecular weight region of at most $1\times10^5$, so as to provide a good fixability. If the component is below 50%, the fixability is lowered and the pulverizability of the melt-kneaded product after cooling during the toner production process is lowered. If the component exceeds 90%, the plasticizing effect due to wax addition is lowered.

In the case of a toner using a polyester resin as a binder resin, the toner may preferably comprise a resinous THF-soluble content which provides a molecular weight distribution as measured by GPC showing a main peak in a molecular weight region of $3\times10^3$–$1.5\times10^4$, more preferably $4\times10^3$–$1.2\times10^4$, particularly preferably $5\times10^3$–$1\times10^4$. It is further preferred that at least one peak or shoulder is present in a molecular weight region of at least $1.5\times10^4$ or the THF-soluble content contains at least 5% of a component in a molecular weight region of at least $5\times10^4$. It is also preferred that the THF-soluble content shows a weight-average molecular weight (Mw)/number-average molecular weight (Mn) ratio of at least 10.

The molecular weight distribution by GPC (gel permeation chromatography) of a toner may be measured by using THF (tetrahydrofuran) in the following manner.

A GPC sample is prepared as follows.

A resinous sample is placed in THF and left standing for several hours (e.g., 5–6 hours). Then, the mixture is sufficiently shaked until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.45–0.5 $\mu$m (e.g., "Maishoridisk H-25-5", available from Toso K.K.; and "Ekikurodisk 25CR", available from German Science Japan K.K.) to recover the filtrate as a GPC sample. The sample concentration is adjusted to provide a resin concentration within the range of 0.5–5 mg/ml.

In the GPC apparatus, a column is stabilized in a heat chamber at 40° C., tetrahydrofuran (THF) solvent is caused to flow through the column at that temperature at a rate of 1 ml/min., and about 100 $\mu$l of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex GPC KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

The toner according to the present invention may preferably further contain a positive or negative charge control agent.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate; quanidine compounds, and imidazole compounds. These may be used singly or in mixture of two or more species. Among these, it is preferred to use a triphenylmethane compound or a quaternary ammonium salt having a non-halogen counter ion. It is also possible to use as a positive charge control agent a homopolymer of or a copolymer with another polymerizable monomer, such as styrene, an acrylate or a methacrylate, as described above of a monomer represented by the following formula (1):

(1)

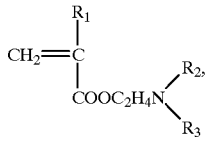

wherein $R_1$ denotes H or $CH_3$; $R_2$ and $R_3$ denotes a substituted or unsubstituted alkyl group (preferably $C_1$–$C_4$). In this instance, the homopolymer or copolymer may be function as (all or a portion of) the binder resin.

It is also preferred to use a compound of the following formula (2) as a positive charge control agent:

(2)

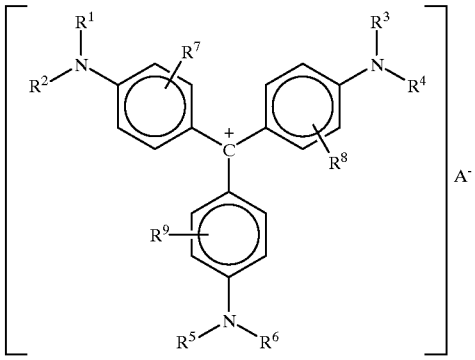

wherein $R^1$, $R^2$, $R^3$, $R^4$, $R^5$ and $R^6$ independently denote a hydrogen atom, a substituted or unsubstituted alkyl group, or a substituted or unsubstituted aryl group; $R^7$, $R^8$ and $R^9$ independently denote a hydrogen atom, a halogen atom, an alkyl group, or an alkoxy group; $A^-$ denotes an anion selected from sulfate, nitrate, borate, phosphate, hydroxyl, organo-sulfate, organo-sulfonate, organo-phosphate, carboxylate, organo-borate and tetrafluoroborate ions.

Examples of the negative charge control agent may include: organic metal complexes, chelate compounds, monoazo metal complexes, acetylacetone metal complexes, organometal complexes of aromatic hydroxycarboxylic acids and aromatic dicarboxylic acids, metal salts of aromatic hydroxycarboxylic acids, metal salts of aromatic polycarboxylic acids, and anhydrides and esters of such acids, and phenol derivatives.

It is also preferred to use as a negative charge control agent an azo metal complex represented by the following formula (3):

(3)

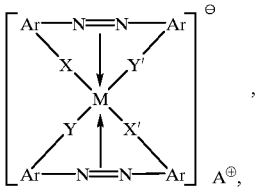

wherein M denotes a coordination center metal, such as Sc, Ti, V, Cr, Co, Ni, Mn or Fe; Ar denotes an aryl group, such as phenyl or naphthyl, capable of having a substituent, examples of which may include: nitro, halogen, carboxyl, anilide, or alkyl or alkoxy having 1–18 carbon atoms; X, X', Y and Y' independently denote —O—, —CO—, —NH—, or —NR— (wherein R denotes an alkyl having 1–4 carbon atoms; and $A^{\oplus}$ denotes a cation, such as hydrogen, sodium, potassium, ammonium or aliphatic ammonium. The cation $A^{\oplus}$ can be omitted.

It is particularly preferred that the center metal is Fe or Cr; the substituent is halogen, alkyl or anilide group; and the cation is hydrogen, alkali metal, ammonium or aliphatic ammonium. It is also preferred to use a mixture of complex salts having different counter ions.

It is also preferred to use as a negative charge control agent as a basic organic acid metal complex represented by the following formula (4):

(4)

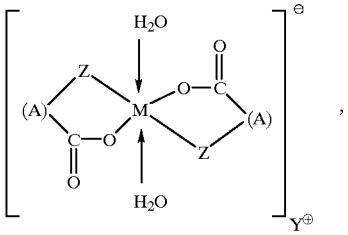

wherein M denotes a coordination center metal, such as Cr, Co, Ni, Mn, or Fe; A denotes

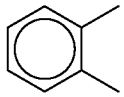

(capable of having a substituent, such as an alkyl,

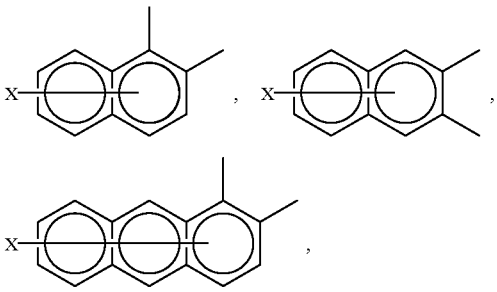

-continued

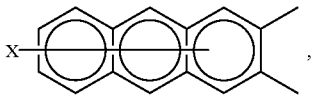

(X denotes hydrogen, halogen, nitro, or alkyl),

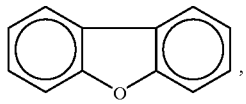

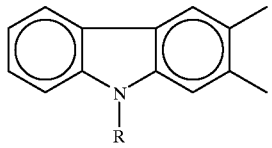

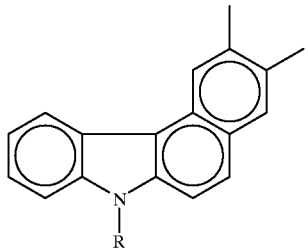

(R denotes hydrogen, $C_1$–$C_{18}$ alkyl or $C_1$–$C_{18}$ alkenyl); $Y^{\oplus}$ denotes a cation, such as hydrogen, sodium, potassium, ammonium, or aliphatic ammonium; and Z denotes —O— or —CO—O—. The cation can be omitted.

It is particularly preferred that the center metal is Fe, Cr, Si, Zn or Al; the substituent is alkyl, anilide or aryl group or halogen; and the cation is hydrogen, ammonium or aliphatic ammonium.

Such a charge control agent may be incorporated in a toner by internal addition into the toner particles or external addition to the toner particles. The charge control agent may be added in ia proportion of 0.1–10 wt. parts, preferably 0.1–5 wt. parts, per 100 wt. parts of the binder resin while it can depend on the species of the binder resin, other additives, and the toner production process including the dispersion method.

It is preferred to use the toner according to the present invention together with silica fine powder externally blended therewith in order to improve the charge stability, developing characteristic and fluidity.

The silica fine powder may provide it has a specific surface area of 20 $m^2/g$ or larger, preferably 30–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also possible to use two or more treating agents in combination.

In order to provide improved developing performance and durability, it is also preferred to further add powder of another inorganic material, examples of which may include: oxides of metals, such as magnesium, zinc, aluminum, cerium, cobalt, iron, zirconium, chromium, manganese, strontium, tin and antimony; composite metal oxides, such as calcium titanate, magnesium titanate, and strontium titanate; metal salts, such as calcium carbonate, magnesium carbonate, and aluminum carbonate; clay minerals, such as haolin; phosphate compounds, such as apatite; phosphate compounds, such as apatite; silicon compounds, such as silicon carbide and silicon nitride; and carbon powder, such as carbon black and graphite powder. Among these, it is preferred to use zinc oxide, aluminum oxide, cobalt oxide, manganese dioxide, strontium titanate or magnesium titanate.

It is also possible to externally add powder of lubricants, examples of which may include: fluorine-containing resins, such as polytetra-fluoroethylene and polyvinylidene fluoride; fluorinated compounds, such as fluorinated carbon; aliphatic acid metal salts, such as zinc stearate; aliphatic acids and derivatives thereof, such as esters; sulfides, such as molybdenum sulfide; amino acids and amino acid derivatives.

The toner according to the present invention can be blended with carrier particles to be used as a two-component type developer. The carrier for use in the two-component developing may comprise known materials, examples of which may include: surface-oxidized or non-oxidized particles of metals, such as iron, nickel, cobalt, manganese, chromium and rare earth metals; alloys and oxides of these metals, each having an average particle size of 20–300 $\mu$m.

These carrier particles may preferably be surface-treated by attachment of or coating with a resin such as styrene resin, acrylic resin, silicone resin, fluorine-containing resin, or polyester resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of at most 2 $\mu$m, preferably 0.1–0.5 $\mu$m, further preferably 0.1–0.3 $\mu$m. The magnetic material may be contained in the toner in a proportion of ca. 20–200 wt. parts, preferably 40–150 wt. parts, per 100 wt. parts of the resin component.

The toner according to the present invention can contain a non-magnetic colorant which may be an appropriate pigment or dye. Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin. Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the wax, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the wax, pigment or dye therein, and cooling and solidifying the kneaded product, followed by pulverization and classification.

The thus obtained toner may be further blended with other external additives, as desired, sufficiently by means of a mixer such as a Henschel mixer to provide a toner for developing electrostatic images.

In order to produce a toner providing a characteristic DSC heat-absorption curve of the present invention, it is preferred to finely and uniformly disperse the wax in the binder resin. If the wax dispersion state is ununiform, the wax is dispersed in large particles or isolated wax particles are formed, it is possible that an identical toner composition fails to provide a desired DSC curve, thus failing to exhibit sufficient toner performances. In order to provide such a desired dispersion state, it is preferred to place a preliminary step of melt-kneading the wax and the binder resin and then to effect a metal-kneading step for melt-kneading other toner ingredients with the melt-kneaded wax-binder resin mixture. It is also preferred to prepare a binder resin solution in a solvent and mixing the wax with the binder resin solution in a wet state, followed by solvent-removal, drying and pulverization, to prepare a wax-binder resin pre-mix, which is then subjected to melt-kneading with the other toner ingredients. It is also preferred to raise the solution temperature at the time of mixing the wax so that the wax in a molten state is mixed with the binder resin solution.

PRODUCTION EXAMPLE 1

| | |
|---|---|
| Styrene | 70 wt. parts |
| n-Butyl acrylate | 26 wt. parts |
| Divinylbenzene | 0.5 wt. parts |
| 2,2-Bis(4,4-di-tert-butyl-peroxycyclohexyl)propane | 0.2 wt. parts |
| Di-tert-butyl peroxide | 0.8 wt. parts |

The above ingredients were added dropwise in 4 hours into 200 wt. parts of xylene under reflux in a reaction vessel and further subjected to solution polymerization in the xylene under reflux. After the polymerization, 4 wt. parts of Wax B (polymethylene wax B) and 2 wt. parts of Wax E (polymethylene wax E) shown in Table 1 below were added to the xylene solution under reflux and dissolved and mixed with the polymerizate styrene copolymer therein, followed by distilling-off of the xylene at a reduced pressure of 100 mmHg at 120° C., to recover Binder resin composition No. 1 comprising a mixture of the crosslinked styrene-n-butyl acrylate copolymer and the waxes. The binder resin composition was dried, pulverized and then subjected to a melt-kneading step described hereinafter.

The crosslinked styrene-n-butyl acrylate copolymer used as the binder resin before the wax addition exhibited a glass transition point (Tg) of 60° C., had a THF-insoluble content of 5 wt. % and contained a THF-soluble content exhibiting a GPC molecular weight distribution including a weight-average molecular weight (Mw)=$1.8\times10^5$, a number-average molecular weight (Mn)=$9.2\times10^3$, Mw/Mn=19.6, a main peak molecular weight (Mp1)=$1.6\times10^4$ and a sub-peak molecular weight (Mp2)=$2.4\times10^5$.

TABLE 1

| Waxes | | |
|---|---|---|
| Wax* | Mn | Mw/Mn |
| A | 290 | 2.1 |
| B | 400 | 1.3 |
| C | 550 | 1.4 |
| D | 740 | 1.6 |
| E | 860 | 1.5 |
| F | 1100 | 1.2 |
| G | 2200 | 5.7 |
| H | 1650 | 4.3 |

*Waxes A–F were polymethylene waxes fractionated from a Fischer-Tropsche wax synthesized from a mixture of carbon monoxide and hydrogen derived from natural gas as the starting material through the Arge produces, among which Waxes A, B and C were obtained by vacuum distillation and Waxes D, E and F were obtained by fractionating crystallization. Wax G was polypropylene wax ("Viscol 550P") and Wax H was polyethylene wax.

PRODUCTION EXAMPLES 2 TO 16

Binder resin compositions Nos. 2 to 16 were prepared in the same manner as in Production Example 1 except for replacing Waxes B and E with one or two waxes, respectively, shown in Table 2 below.

TABLE 2

| Binder resin composition | Wax 1 (wt. parts) | Wax 2 (wt. parts) |
|---|---|---|
| No. 1 | B (4) | E (2) |
| No. 2 | A (3) | E (3) |
| No. 3 | C (5) | F (1) |
| No. 4 | A (4) | F (2) |
| No. 5 | B (5) | D (3) |
| No. 6 | C (4) | E (3) |
| No. 7 | B (4) | — |
| No. 8 | — | E (4) |
| No. 9 | A (6) | — |
| No. 10 | B (6) | — |
| No. 11 | C (6) | — |
| No. 12 | — | D (6) |
| No. 13 | — | E (6) |
| No. 14 | — | F (6) |
| No. 15 | — | G (6) |
| No. 16 | — | H (6) |

Example 1

| | |
|---|---|
| Binder resin composition No. 1 | 100 wt. parts |
| Magnetite (number-average particle size (D1) = 0.2 μm) | 90 wt. parts |
| Triphenylmethane compound (positive charge control agent) | 2 wt. parts |

The above ingredients were preliminarily blended with each other by a Henschel mixer and melt-kneaded through a twin-screw extruder set at 110° C. The melt-kneaded product was cooled, coarsely crushed by a cutter mill and then finely pulverized by a jet mill, followed by classification by a multi-division classifier utilizing the Coanda effect, to recover positively chargeable magnetic toner particles having a weight-average particle size (D4) of 7.0 μm. Then, 100 wt. parts of the magnetic toner particles were blended with 0.9 wt. part of positively chargeable hydrophobic silica externally added thereto by means of a Henschel mixer to obtain Magnetic toner No. 1. The DSC characteristics of Magnetic toner No. 1 were summarized in Table 3 appearing hereinafter together with those of the magnetic toners prepared in Examples and Comparative Examples described below.

Examples 2 to 6

Magnetic toners Nos. 2 to 6 were prepared in the same manner as in Example 1 except for using Binder resin compositions Nos. 2 to 6, respectively, instead of Binder resin composition No. 1.

Comparative Examples 1 to 10

Magnetic toners Nos. 7 to 16 were prepared in the same manner as in Example 1 except for using Binder resin compositions Nos. 7 to 16, respectively, instead of Binder resin composition No. 1.

TABLE 3

| Ex. and Comp. Ex. | Toner No. | Toner D4 (μm) | DSC characteristics of toners T1 (° C.) | T2 (° C.) | T3 (° C.) | T3–T2 (° C.) | TP1 (° C.) | TP2 (° C.) | P2/P1 | V/P2 |
|---|---|---|---|---|---|---|---|---|---|---|
| Ex. 1 | 1 | 7.0 | 58 | 75 | 109 | 34 | 77 | 102 | 0.18 | — |
| 2 | 2 | 6.8 | 54 | 70 | 102 | 32 | 72 | 95 | 0.44 | 0.86 |
| 3 | 3 | 7.2 | 57 | 79 | 118 | 38 | 83 | 108 | 0.38 | — |
| 4 | 4 | 69 | 54 | 69 | 121 | 52 | 71 | 110 | 0.31 | 0.65 |
| 5 | 5 | 7.1 | 55 | 74 | 103 | 29 | 77 | 97 | 0.58 | — |
| 6 | 6 | 6.9 | 58 | 80 | 111 | 31 | 84 | 105 | 0.62 | 0.77 |
| Comp. Ex. 1 | 7 | 7.0 | 56 | 75 | 85 | 10 | 78 | — | — | — |
| 2 | 8 | 7.1 | 58 | 98 | 112 | 14 | — | 105 | — | — |
| 3 | 9 | 7.2 | 53 | 68 | 76 | 8 | 72 | — | — | — |
| 4 | 10 | 7.0 | 55 | 74 | 86 | 12 | 78 | — | — | — |
| 5 | 11 | 6.9 | 56 | 78 | 89 | 11 | 83 | — | — | — |
| 6 | 12 | 6.8 | 58 | 91 | 104 | 15 | — | 98 | — | — |
| 7 | 13 | 7.0 | 58 | 97 | 114 | 17 | — | 106 | — | — |
| 8 | 14 | 6.9 | 59 | 106 | 122 | 16 | — | 112 | — | — |
| 9 | 15 | 7.1 | 60 | 135 | 151 | 16 | — | 145 | — | — |
| 10 | 16 | 7.2 | 60 | 123 | 128 | 5 | — | 126 | — | — |

The toners prepared in Examples 1 to 10 and Comparative Examples 1 to 10 were respectively subjected to evaluation of fixability, anti-offset characteristic, continuous developing performance, anti-winding property, and continuous image performance, respectively, in the following manner. The results of the evaluation are inclusively shown in Table 4 appearing hereinafter.

For example, the toner of Example 1 exhibited good fixability and developing performance, was free from occurrence of separation claws in fixed image due to winding-up about the fixing roller, and was also free from soiling of copied images when used as originals supplied through an automatic document feeder.

Fixability and Anti-offset Characteristic

A commercially available electrophotographic copying machine ("NP-6030", available from Canon K.K.) was remodeled by taking out the fixing device and equipping it with an external heating roller fixing device capable of changing the fixing temperature, whereby unfixed toner images formed by the copying machine were subjected to fixing at varying fixing temperatures so as to evaluate the fixability and anti-offset characteristic of each toner.

The external fixing device was operated at a nip width of 5.0 mm, a process speed of 180 mm/sec. and varying fixing temperatures at increments of 5° C. in the range of 120–250° C.

Each fixed toner images was rubbed for 5 cycles of reciprocations with a lens-cleaning paper under a load of 50 g/cm$^2$ so as to evaluate the fixability of the toner in terms of a fixing-initiation temperature as a lowest temperature giving an image-density lowering due to rubbing of at most 10%.

The anti-offset characteristic was evaluated by observing fixed image with eyes to determine an offset-free temperature range including a minimum temperature and a maximum temperature between which soiling of images with offset toner was not caused.

Continuous Developing Performance

Continuous image formation was performed on 20,000 sheets by copying of an A4-size original having an areal image percentage of 6% by using a commercially available electrophotographic copying machine ("NP-6030", available from Canon K.K.) in an intermittent mode including a cycle of 8 hours of operation and 16 hours of pause and, in the operation period, image formation was continuously performed on two sheets at a process speed of 20 mmsec. for each 15 sec. period, whereby the image density stability of the copied image was evaluated according to the following standard:

A: No image density irregularity on the images, and good and stable image density.

B: No image density irregularity on the images, but some lowering in image density.

C: Image density irregularity on the images, and lowering in image density.

Fixing Roller Winding-up

An electrophotographic copying machine ("NP-6030") was used for copying of an A3-size original having an areal image percentage of 100% continuously on 20-sheets of A3-size plain paper to evaluate the winding-up characteristic of each toner based on the presence or absence of traces of the fixing paper discharge separation claws on the resultant images. The results were evaluated according to the following standard. (For reference, if a toner shows an inferior fixing roller-winding property, the peeling of the paper carrying a fixed toner image from the fixing roller is liable to be effected by severely relying on the separation claws, so that the trace of the separation claws is liable to appear on the resultant images. On the other hand, if a toner shows a good releasability from the fixing roller, the peeling of the paper carrying a fixed toner image is easily performed with the aid of the separation claws, so that no trace of the separation claws results in the fixed toner images.)

A: No trace of separation claws on the fixed solid images.

B: Some trace of separation claws on the fixed solid images.

C: Remarkable trace of separation claws on the fixed solid images.

Original Soiling Test

An automatic document feeder of an electrophotographic copying machine ("NP-6030") was operated to evaluate the soiling of copied images when supplied as original therethrough. More specifically, 40 sheets of A4 size copied images having an areal image percentage of 6% obtained through the above-mentioned continuous developing performance test were supplied as originals through the automatic document feeder continuously 5 times each, whereby the soiling of the originals was evaluated according to the following standard.

A: No soiling on the originals.

B: Some soiling on the original.

C: Remarkable soiling on the originals.

TABLE 4

| | | | Evaluation results | | | | | | |
|---|---|---|---|---|---|---|---|---|---|
| | | | Fixing | Off set-free range | | | | | |
| Ex. or Comp. Ex. | | Toner | temp. (° C.) | Tmin. (° C.) | Tmax. (° C.) | Developing performance | Image density | Anti-winding | Soiling of original |
| Ex. | 1 | 1 | 150 | 140 | 240 | A | 1.35–1.38 | A | A |
| | 2 | 2 | 150 | 140 | 245 | A | 1.32–1.35 | A | A |
| | 3 | 3 | 155 | 145 | 235 | A | 1.36–1.39 | A | A |
| | 4 | 4 | 145 | 135 | 240 | A | 1.33–1.37 | A | A |
| | 5 | 5 | 145 | 135 | 250 | A | 1.34–1.38 | A | A |
| | 6 | 6 | 155 | 145 | 250 | A | 1.36–1.38 | A | A |
| Comp. Ex. | 1 | 7 | 150 | 140 | 200 | B | 1.25–1.35 | B | A |
| | 2 | 8 | 165 | 155 | 240 | A | 1.35–1.38 | A | B |
| | 3 | 9 | 150 | 140 | 190 | B | 1.25–1.31 | C | C |
| | 4 | 10 | 150 | 140 | 195 | B | 1.27–1.32 | C | B |
| | 5 | 11 | 155 | 145 | 200 | A | 1.32–1.36 | C | B |
| | 6 | 12 | 160 | 155 | 240 | A | 1.31–1.37 | A | B |
| | 7 | 13 | 165 | 155 | 240 | A | 1.30–1.36 | A | B |
| | 8 | 14 | 165 | 160 | 240 | A | 1.32–1.38 | A | B |
| | 9 | 15 | 170 | 165 | 235 | B | 1.22–1.26 | C | C |
| | 10 | 16 | 170 | 165 | 240 | B | 1.25–1.31 | B | B |

As a brief supplement to the results shown in Table 4, compared with the toner of Example 1, the comparative toners exhibited the following performances.

The toner of Comparative Example 1 exhibited inferior high-temperature-offset characteristic, resulted in a slight lowering in image density during continuous image formation, and also resulted in the trace of separation claws on the solid black fixed images.

The toner of Comparative Example 2 exhibited inferior fixability and resulted in some soiling of the originals.

The toners of Comparative Examples 3–5 and 9 exhibited remarkably inferior anti-winding characteristic.

The toners of Comparative Examples 6–8 and 10 exhibited inferior fixability and anti-low-temperature offset characteristic.

What is claimed is:

1. A toner for developing an electrostatic image, comprising: a binder resin, a colorant and a wax;

wherein the toner shows heat-absorption characteristics represented by a DSC heat-absorption curve obtained on temperature increase in a temperature range of 30–150° C. by a differential scanning calorimeter (DSC);

said DSC heat-absorption curve showing a maximum heat-absorption peak (P1) in a temperature range of 70–90° C. and a sub-heat absorption peak or shoulder (P2) in a temperature range of 85–115° C., wherein the maximum heat-absorption peak (P1) shows a height Hp1 and the sub-heat-absorption peak or shoulder (P2) shows a height Hp2 from a base line of the DSC heat-absorption peak, satisfying the ratio Hp2/Hp1≦0.7 and wherein a valley, if present, forming a lowest point on the DSC heat-absorption curve between the maximum heat absorption peak (P1) and the sub-heat absorption peak or shoulder (P2) shows a height Hv satisfying a ratio Hv/Hp2 of at least 0.5, said DSC curve providing a differential curve showing a first maximum (Max1) on a lowest temperature side at a temperature (T1) of 50–65° C., showing a second maximum (Max2) on a next lowest temperature side at a temperature (T2) of 65–85° C., and showing a minimum (Min1) on a highest temperature side at a temperature (T3) of at least 95° C.

2. The toner according to claim 1, wherein the differential curve of the DSC heat-absorption curve provides a first maximum (Max1) at a temperature (T1) of 50–60° C.

3. The toner according to claim 1, wherein the differential curve of the DSC heat-absorption curve shows a first minimum (Min1) at a temperature T3 and a second maximum (Max2) at a temperature T2, satisfying a relationship of:

$$T3-T2 \geqq 25° \text{ C.}$$

4. The toner according to claim 1, wherein the DSC heat-absorption curve of the toner shows a maximum heat-absorption peak (P1) at a temperature of 70–85° C. and provides a differential curve showing a second maximum Max2 at a temperature (T2) of 65–80° C. and a first minimum (Min1) at a temperature of at least 100° C.

5. The toner according to claim 1, wherein the differential curve of the DSC heat-absorption curve shows a first minimum (Min1) at a temperature T3 and a second maximum (Max2) at a temperature T2, satisfying a relationship of:

$$T3-T2 \geqq 30^\circ \text{ C.}$$

6. The toner according to claim 1, wherein the differential curve of the DSC heat-absorption curve shows a minimum (Min1) at a temperature of 100–120° C.

7. The toner according to claim 1, wherein the wax is contained in 1–20 wt. parts per 100 wt. parts of the binder resin.

8. The toner according to claim 1, wherein the wax is contained in 1–10 wt. parts per 100 wt. parts of the binder resin.

9. The toner according to claim 1, wherein the wax has a number-average molecular weight (Mn) of 200–5000 and a weight-average molecular weight (Mw)/Mn ratio of at most 3.0.

10. The toner according to claim 9, wherein the wax has Mn of 250–2000.

11. The toner according to claim 9, wherein the wax has Mn of 300–1500.

12. The toner according to claim 1, wherein the wax comprises a polymethylene wax.

13. The toner according to claim 1, wherein the wax comprises a wax mixture of (i) a polymethylene wax having Mn=200–600 and Mw/Mn=1.2–2.1 and (ii) a polymethylene wax having Mn=700–1500 and Mw/Mn=1.2–2.0.

14. The toner according to claim 13, wherein the wax comprises a wax mixture of the polymethylene wax (i) and the polymethylene wax (ii) in a weight ratio of 9:1 to 3:7.

15. The toner according to claim 13, wherein the wax comprises a wax mixture of the polymethylene wax (i) and the polymethylene wax (ii) in a weight ratio of 8:2 to 3:7.

* * * * *

UNITED STATES PATENT AND TRADEMARK OFFICE

CERTIFICATE OF CORRECTION

PATENT NO. : 6,120,961

DATED : September 19, 2000

INVENTOR(S) : HIROHIDE TANIKAWA, ET AL.

It is certified that error appears in the above-identified patent and that said Letters Patent is hereby corrected as shown below:

COLUMN 4

Line 15, "100 130°C.," should read --100-130°C.,--;
Line 22, "operates," should read --operate,--;
Line 26, "be" should be deleted.

COLUMN 9

" (A) "

Formula (A)

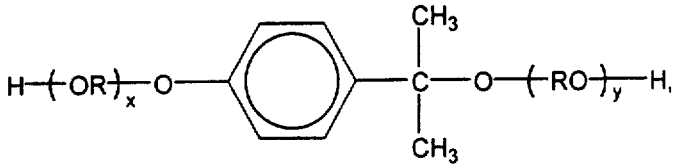

should read

-- 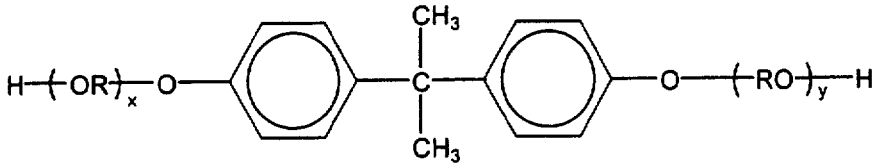 (A),--.

COLUMN 10

Line 65, "constitutes" should read --constitute--.

COLUMN 11

Line 7, "by" should be deleted.

UNITED STATES PATENT AND TRADEMARK OFFICE

CERTIFICATE OF CORRECTION

PATENT NO. : 6,120,961

DATED : September 19, 2000

INVENTOR(S) : HIROHIDE TANIKAWA, ET AL.

It is certified that error appears in the above-identified patent and that said Letters Patent is hereby corrected as shown below:

COLUMN 15

Line 41, "in ia" should read --in a--.

COLUMN 18

Table 1, Entire paragraph should be a footnote.

-- *Waxes A-F were polymethylene waxes fractionated from a Fischer-Tropsche wax synthesized from a mixture of carbon monoxide and hydrogen derived from natural gas as the starting material through the Arge produces, among which Waxes, A, B and C were obtained by vacuum distillation and Waxes D, E and F were obtained by fractionating crystallization. Wax G was polypropylene wax ("Viscol 550P") and Wax H was polyethylene wax.--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*